US009306269B2

(12) United States Patent
Jouanlanne et al.

(10) Patent No.: US 9,306,269 B2
(45) Date of Patent: Apr. 5, 2016

(54) ELECTRONIC APPARATUS WITH RADIO ANTENNA FOLDED IN A CASING

(71) Applicant: COMMISSARIAT A L'ENERGIE ATOMIQUE ET AUX ENERGIES ALTERNATIVES, Paris (FR)

(72) Inventors: Cyril Jouanlanne, Grenoble (FR); Christophe Delaveaud, St Jean de Moirans (FR); Jean-François Pintos, Saint-Blaise-du-Buis (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 8 days.

(21) Appl. No.: 14/555,871

(22) Filed: Nov. 28, 2014

(65) Prior Publication Data

US 2015/0145733 A1 May 28, 2015

(30) Foreign Application Priority Data

Nov. 28, 2013 (FR) ..... 13 61795

(51) Int. Cl.

| | |
|---|---|
| ***H01Q 1/24*** | (2006.01) |
| ***H01Q 9/42*** | (2006.01) |
| ***H01Q 1/36*** | (2006.01) |
| ***H01Q 1/38*** | (2006.01) |

(52) U.S. Cl.

CPC ..... *H01Q 1/243* (2013.01); *H01Q 1/36* (2013.01); *H01Q 1/38* (2013.01); *H01Q 9/42* (2013.01)

(58) Field of Classification Search

CPC ..... H01Q 1/243; H01Q 1/242; H01Q 1/24; H01Q 9/42; H01Q 1/38

USPC ..... 343/702

See application file for complete search history.

(56) References Cited

U.S. PATENT DOCUMENTS

| | | | | |
|---|---|---|---|---|
| 7,642,964 | B2 * | 1/2010 | DiNallo | H01Q 1/243 343/700 MS |
| 8,339,323 | B2 * | 12/2012 | Qi | H01Q 1/243 343/702 |
| 8,618,991 | B2 * | 12/2013 | Jung | H01Q 1/243 343/700 MS |
| 8,659,487 | B2 * | 2/2014 | Fan | H01Q 1/364 343/700 MS |
| 9,002,262 | B1 * | 4/2015 | Kuo | H01Q 1/50 343/702 |
| 9,035,847 | B2 * | 5/2015 | Hong | B29C 45/14065 343/702 |
| 2010/0156726 | A1 | 6/2010 | Montgomery et al. | |

FOREIGN PATENT DOCUMENTS

| | | | |
|---|---|---|---|
| EP | 2562871 | A1 | 2/2013 |
| WO | 2008126277 | A1 | 10/2008 |
| WO | 2010138453 | A2 | 12/2010 |

* cited by examiner

*Primary Examiner* — Hoang V Nguyen
(74) *Attorney, Agent, or Firm* — Baker & Hostetler LLP

(57) ABSTRACT

In the field of electronic apparatuses that can be held in the hand and that comprise a miniaturized radio antenna, an apparatus comprises a casing of generally parallelepipidal form with a main face and a first small side. The antenna extends partly along the main face and partly over the first side. It comprises a conductive structure divided up so as to form a meandering inductive conductive line linked to a main conductive surface which extends over most of the first side and which is folded at the ends of this first side onto a second and a third side adjacent to the main face to form two folded lateral wings, at least one respective slot being provided to separate each wing from the main conductive surface and thus narrow and lengthen the paths of the electric currents going to the folded lateral wings.

4 Claims, 2 Drawing Sheets

ELECTRONIC APPARATUS WITH RADIO ANTENNA FOLDED IN A CASING

CROSS-REFERENCE TO RELATED APPLICATION

This application claims priority to foreign French patent application No. FR 1361795, filed on Nov. 28, 2013, the disclosure of which is incorporated by reference in its entirety.

FIELD OF THE INVENTION

The invention relates to the electronic apparatuses that comprise radio communication means and which therefore comprise a radio transmission and/or reception antenna. It relates more particularly to the portable apparatuses that can be held in a hand, therefore apparatuses of small size.

BACKGROUND

When the carrier frequency of the radio communication is relatively low, for example 400 or 500 MHz, the dimensions of the casing of the apparatus are too small for it to be possible to use a so-called quarter-wave monopole or dipole antenna, that is to say an antenna whose conductive strands have a dimension of the order of a quarter of the wavelength. For a frequency of 400 MHz (wavelength of 75 centimeters), the length of the strand would be of the order of 20 centimeters and strands of this length cannot be housed in a casing with sides of 8 or 10 centimeters. In particular, it is not possible to use a monopole antenna configuration in the form of a conductive strand arranged at right angles to a ground plane.

It is necessary to use more sophisticated antenna designs, slotted or meandering, and the ground plane generally consists of all the electronic elements inside the casing (printed circuit boards, display screen, power supply batteries). The antenna itself is necessarily very close to this ground plane and it is essential to be able to place it inside the casing in such a way that it has a sufficient efficiency of illumination despite this proximity.

More often than not, the main faces of the casing that is assumed parallelepipedal will be occupied largely by a display screen considered to form part of the ground plane. These main faces are, for all practical purposes, not available to place an antenna thereon or even a significant antenna portion. It is known to those skilled in the art that the metal frame and/or the main printed circuit board (PCB) on which the different constituent elements of the apparatus are placed form an integral part of the antenna. Nevertheless, one way of exciting the antenna in the casing then consists in placing most of the conductive surfaces of the antenna driver unit on a small side of the parallelepipedal casing, sufficiently far from the electrical elements which constitute the ground plane.

The electrical field lines leave from the small side to what is considered to be the ground plane.

The efficiency of illumination of the antenna, which is equal to the ratio of the actual radiated power to the electrical power accepted by the antenna, is degraded on the one hand by a poor distribution of the radiated electrical fields and on the other hand by the presence of the casing which is passed through by these field lines and which causes dielectric losses; the casing is often made of ABS (acrylonitrile-butadiene-styrene), which is a lossy material.

In this context, the aim of the invention is to propose a novel antenna configuration in a casing of an electronic apparatus, which makes it possible to obtain the best possible efficiency of illumination.

SUMMARY OF THE INVENTION

An electronic apparatus is therefore proposed that comprises radio communication means (e.g. radio communication circuits) and a casing of generally parallelepipedal form intended to be held in a hand, with a first and a second main face and four sides adjacent to these main faces, and an antenna extending partly on one of said main faces, called first main face, and partly on one of said sides, called first side, wherein the antenna comprises a conductive structure divided up so as to form a meandering inductive conductive line linking an excitation point to a single main conductive surface which extends over most of the first side and which is folded at the ends of this first side onto respective sides, called a second and a third side, adjacent to the main faces to form two folded lateral wings, at least one respective slot being provided to separate each folded lateral wing from the main conductive surface and thus narrow and lengthen the paths of the electric currents going to the folded lateral wings.

Advantageously, each slot may separate the main conductive surface and the respective folded lateral wing by extending from the first main face, the conductive link between the main conductive surface and the respective folded lateral wing being realized to the side of the second main face.

Advantageously, each slot may establish a conductive path of inductive type between the main conductive surface and the lateral wings.

The slot establishes conductive lines which are inductive because of their small width/length ratio, between the parts situated on the first side and the folded lateral wings on the second and third sides, and these inductive lines help to greatly reduce the currents in the folded wings. The result thereof is an emission of electrical fields that are stronger and better distributed in all directions from these wings situated on two corners of the casing. The overall efficiency of illumination is thereby significantly enhanced.

BRIEF DESCRIPTION OF THE DRAWINGS

Other features and advantages of the invention will become apparent on reading the following detailed description which is given with reference to the attached drawings, in which.

DETAILED DESCRIPTION

Figure 1:
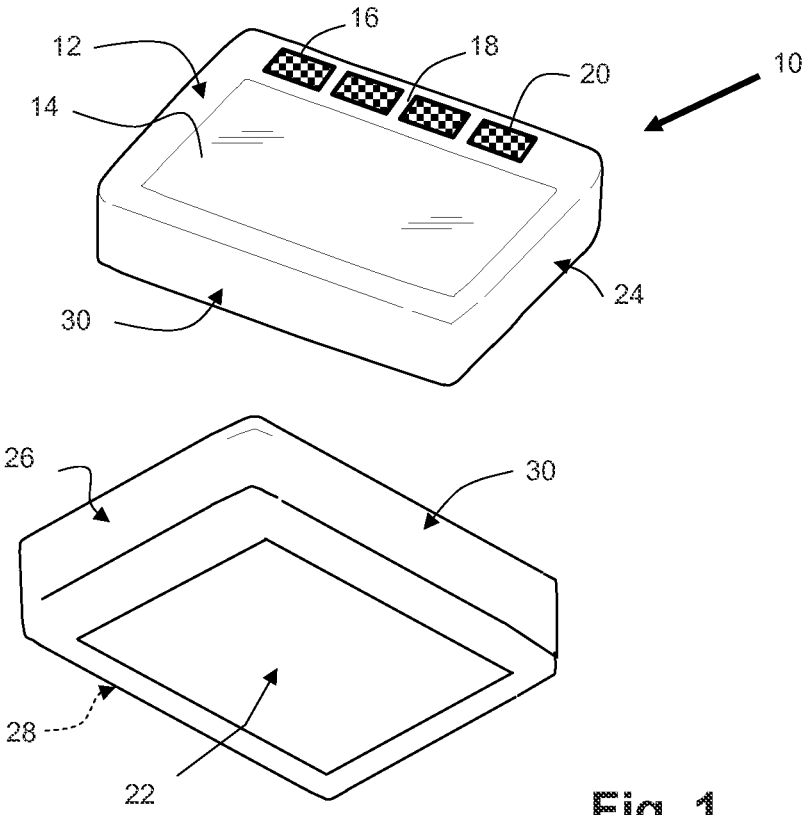
FIG. 1 represents, in perspective, in plan view and in bottom view, a parallelepipedal electronic apparatus casing.

FIG. 1 shows an electronic apparatus contained in a parallelepipedal casing 10 that can be held in the hand. The casing has a top main face 12 which can bear a display screen 14 and control buttons 16, 18, 20. The top face can have side dimensions of 7 to 10 centimeters for example for the greater dimension and from 4 to 8 centimeters for the smaller dimension. The bottom face 22 can contain a recess for a power supply battery. The casing has four small sides, adjacent to the top face and the bottom face, which can have a height of 1 to 3 centimeters for example; three small sides are designated by the references 24, 26, 28; the last small side will be referenced 30 for convenience of explanation, but it is not visible in FIG. 1.

The electronic elements contained in the casing are not represented. The apparatus is intended, despite its small size, to communicate by radio in the UHF (Ultra High Frequency) band and more specifically at frequencies that can range from 380 MHz to 430 MHz.

Figure 2:
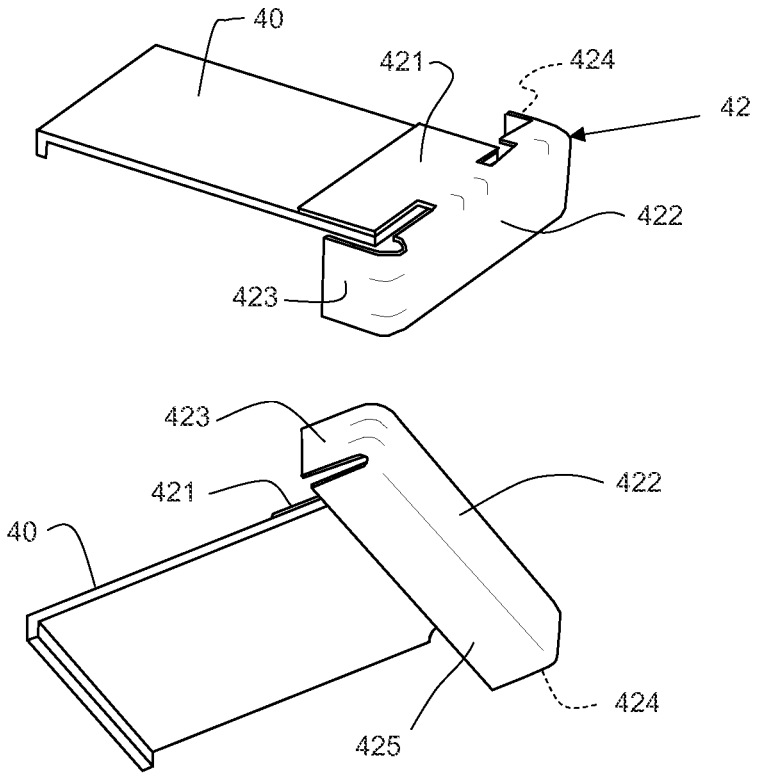
FIG. 2 represents, in plan view and in bottom view, an antenna support piece making it possible to fold the antenna over a first small side and over two other sides.

FIG. 2 represents a support for the radio transmission-reception antenna, making it possible to install the driver part of the antenna inside the casing, essentially along the small side 24 of the casing and partially also on the sides 28 and 30. The support is seen from above (top part of FIG. 2) and from below (bottom part of FIG. 2).

The support comprises a rigid plate 40 which can serve as a support for other elements of the apparatus (for example the display screen); a flexible printed sheet 42 (of imide-based polymer such as Kapton, a trademark registered by the company Dupont) is glued to the end of the plate 40, on the side which will face towards the first small side 24, and will serve as a support for the antenna. This sheet is cut and shaped with folds so as to be able to follow the form of the casing against the small side 24 and also partly against a second (28) and a third (30) small sides, adjacent to the first small side; furthermore, this sheet is preferably folded also partly along the bottom face 22 opposite the main face.

This flexible sheet 42 is a printed circuit sheet; it is coated with a conductive layer cut according to a pattern which constitutes a part of the antenna, the other part being the above mentioned ground plane. For convenience, hereinafter in the description, only the part containing the conductive pattern will be called antenna. This pattern is not represented in FIG. 2 which represents only the general form of the sheet 42. The pattern will be described later.

The flexible sheet therefore comprises, when it is installed in the casing, five different parts: a part 421 parallel to the main face 12 on a small part thereof and glued onto the support 40; a part 422 parallel to the first small side 24 and occupying most or even all or almost all of this first side; a first wing 423 folded along the third small side 30 from the corner joining the first and third small sides; a second wing 424 folded along the second small side (28) from the corner joining the first and the second small sides; and finally a part 425 folded on the bottom face 22 of the casing from the corner joining the first small side 24 and the bottom face 22 of the casing. The flexible sheet is entirely contained inside the casing.

The wings extend over 1 to 3 centimeters along the second and third small sides, but no more, so as not to approach over too great a length of the ground plane consisting notably of the display screen and the main printed circuit of the casing.

Figure 3:
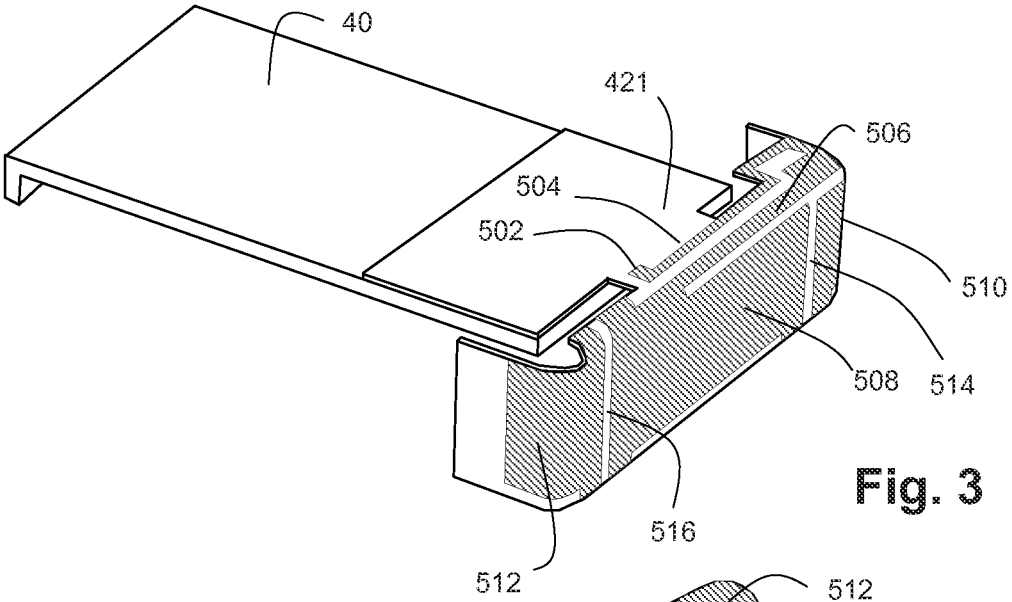
FIG. 3 represents, in plan view, the antenna on its support.
Figure 4:
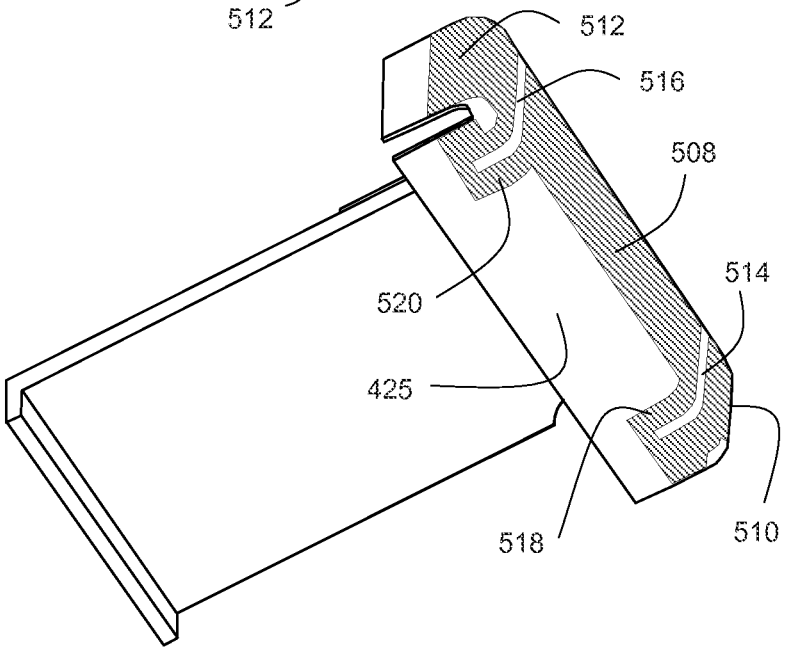
FIG. 4 represents, in bottom view, the antenna on its support.

FIGS. 3 and 4 respectively represent, in a view from above and a view from below, the detail of the conductive structure etched on the flexible sheet for forming the antenna of the apparatus according to the invention. The conductive part is represented as a shaded surface.

This conductive structure comprises a meandering line having a signal excitation point 502 arranged on the top part 421 of the flexible sheet so as to be able to transmit or receive a radio signal from or to the internal electronic circuits of the casing.

The excitation point is situated at the end of a narrow conductive strand 504 which extends parallel to the face 422 of the sheet, that is to say parallel to the first small side 24. This strand is extended by another narrow strand 506 which turns back at 180° from the first strand and is separated therefrom by a gap. The two strands are by nature inductive given their narrowness and their length which is very much greater than their width.

The end of the second strand 506 meets a main conductive surface 508 which occupies almost all the surface 422 folded along the first small side 24 of the casing.

The antenna structure also comprises two conductive wings 510 and 512 which form a capacitance between the ground plane and the antenna; they are borne by the folded wings 423 and 424 of the printed flexible sheet and they occupy the greater part thereof. However, these conductive wings 510 and 512 are not directly adjacent to the main surface 508. They are separated partly from this surface by respective narrow slots 514 and 516 which narrow and lengthen the current path between the main conductive surface 508 and the wings 510 and 512, unlike what would occur if the wings 510 and 512 were adjacent over their entire height to the main surface 508.

In the example represented, the conductive link 518 or 520 which remains, where the slot stops, between the main surface 508 and the wing 510 or 512, forms a meander of inductive type (conductors of length very much greater than their width). This conductive link 518 or 520 is partly folded onto the bottom face 425 of the flexible sheet. It will be noted that the conductive link 518 or 520 can also be limited to the surface 422, without folding onto the bottom face 425 of the flexible sheet.

Figure 5:
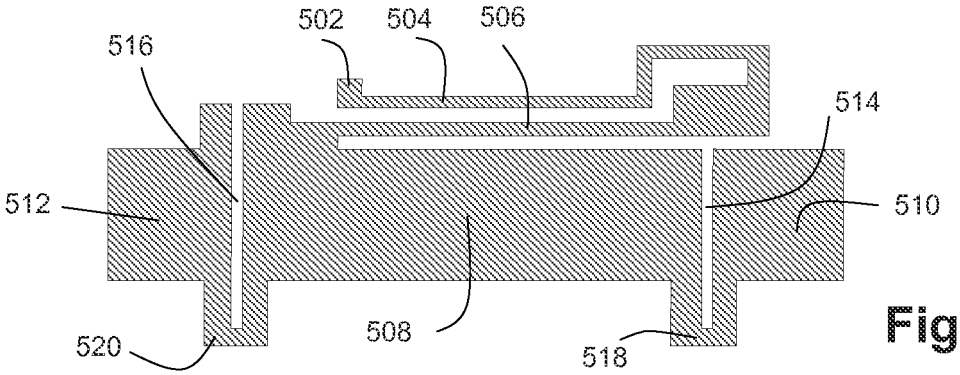
FIG. 5 represents the conductive structure of the antenna, developed on a plane.

Finally, FIG. 5 represents a developed view in a plane of all of the antenna that has been represented in perspective in FIGS. 3 and 4. The references and explanations are the same as in FIGS. 3 and 4.

Because of the relatively low desired working frequencies despite the small bulk of the casing, the interactions between the ground plane and the conductive structure of the antenna limit the performance levels in terms of efficiency of illumination, compared to the efficiency that would be obtained with a conventional monopole or dipole antenna at right angles to a ground plane. In the structure according to the invention, the slots which narrow and lengthen the current path between the capacitive conductive surface 508 and the folded conductive lateral wings 510 and 512 considerably weaken the currents in the folded wings. This weakening of the currents establishes a stronger electrical field in the folded wings and establishes electrical field lines that are better distributed in all directions between the radiating conductive surfaces (more particularly the folded wings) and the ground plane, which overall enhances the efficiency of illumination. As an alternative embodiment, instead of a single slot 514, 516 between the capacitive conducting surface 508 and the wings 510, 512, several slots may be provided for narrowing and lengthening the paths of the electric current between the capacitive conducting surface 508 and the folded lateral conducting wings 510, 512. In this case the slot can, for instance, extend alternatively from the face 421 and the lower face 425 to form meandering structures between the surface 508 and any of the wings 510, 512.

The areas which radiate the most are then the corners of the casing (corners between the first small side 24 and the other two adjacent small sides 28 and 30). These corners are the parts furthest away from the ground plane. The electrical fields are therefore distributed all the better in all directions.

The efficiency of illumination can be significantly increased (increase of approximately 10% in efficiency of illumination which can be approximately 30% for this type of antenna).

The invention claimed is:

1. An electronic apparatus comprising radio communication circuits and a casing of generally parallelepipedal form intended to be held in a hand, with a first and a second main face and four sides adjacent to said main faces, and an antenna extending partly on one of said main faces, being a first main face, and partly on one of said sides, being a first side, wherein the antenna comprises a conductive structure divided up so as to form a meandering inductive conductive line linking an excitation point to a single main conductive surface which extends over most of the first side and which is folded at the ends of the first side onto respective sides, being a second and a third side, adjacent to the main faces to form two folded lateral wings, at least one respective slot being provided to separate each folded lateral wing from the main conductive surface and thus narrow and lengthen the paths of the electric currents going to the folded lateral wings.

2. The electronic apparatus of claim 1, wherein each slot separates the main conductive surface and the respective folded lateral wing by extending from the first main face, the conductive link between the main conductive surface and the respective folded lateral wing being realized to the side of the second main face.

3. The electronic apparatus of claim 2, wherein each slot establishes a conductive path of inductive type between the main conductive surface and the folded lateral wings.

4. The electronic apparatus of claim 1, wherein each slot establishes a conductive path of inductive type between the main conductive surface and the folded lateral wings.

* * * * *